US012385660B2

(12) United States Patent
Adil et al.

(10) Patent No.: US 12,385,660 B2
(45) Date of Patent: Aug. 12, 2025

(54) METHOD AND SYSTEM FOR SCALABLE EMBEDDED MODEL PREDICTIVE CONTROL OF HVAC SYSTEMS

(71) Applicant: PALO ALTO RESEARCH CENTER INCORPORATED, Palo Alto, CA (US)

(72) Inventors: Muhammad Adil, Arlington, TX (US); Raman Goyal, Mountain View, CA (US); Saman Mostafavi, San Francisco, CA (US); Subhashis Hazarika, Mountain View, CA (US); David E. Schwartz, Concord, MA (US)

(73) Assignee: Xerox Corporation, Norwalk, CT (US)

( * ) Notice: Subject to any disclaimer, the term of this patent is extended or adjusted under 35 U.S.C. 154(b) by 407 days.

(21) Appl. No.: 18/089,948

(22) Filed: Dec. 28, 2022

(65) Prior Publication Data

US 2024/0230130 A1 Jul. 11, 2024

(51) Int. Cl.

| | |
|---|---|
| ***F24F 11/46*** | (2018.01) |
| ***F24F 11/63*** | (2018.01) |
| *F24F 110/10* | (2018.01) |

(52) U.S. Cl.

CPC ..... *F24F 11/46* (2018.01); *F24F 11/63* (2018.01); *F24F 2110/10* (2018.01)

(58) Field of Classification Search

CPC ..... F24F 11/46; F24F 11/63

See application file for complete search history.

(56) References Cited

U.S. PATENT DOCUMENTS

| | | | | |
|---|---|---|---|---|
| 10,700,942 | B2 | 6/2020 | Hamilton et al. | |
| 2015/0134124 | A1 * | 5/2015 | Carter | G06N 5/04 700/278 |
| 2018/0275044 | A1 * | 9/2018 | Surana | G01N 19/08 |

FOREIGN PATENT DOCUMENTS

| | | | |
|---|---|---|---|
| EP | 3 088 972 B1 | 7/2022 | |
| WO | WO-2016135514 A1 * | 9/2016 | G05B 13/027 |

OTHER PUBLICATIONS

Bacher, et al., "Identifying suitable models for the heat dynamics of buildings," 2011, Energy and Buildings, 25 pages.

(Continued)

*Primary Examiner* — Mark A Connolly

(74) *Attorney, Agent, or Firm* — Mueting Raasch Group

(57) ABSTRACT

A physics model of a building is linearized around an operating point. Measurements received from sensors define a system state of the HVAC system. The linearized physics model is used as an equality constraint for a model predictive controller that determines a next control input to the HVAC system based on the system state by solving an optimization problem for a time horizon of size N. A constraint matrix H of the equality constraint is decomposed into factors of U and V matrices such that $UU^T$ and $V^TV$ are both diagonal matrices. An objective function of the model predictive controller is optimized by iteratively solving a linear system of equations that includes inverses of $UU^T$ and $V^TV$ to determining a sequence of inputs for a horizon of the model predictive controller. A first input of the sequence of inputs to is used to control the HVAC system.

20 Claims, 8 Drawing Sheets

(56) References Cited

OTHER PUBLICATIONS

Kelman et al, "Bilinear Model Predictive Control of a HVAC System Using Sequential Quadratic Programming," 2011, International Federation of Automatic Control (IFAC), 6 pages.
Zeng et al., "Identification of Network Dynamics and Disturbance for a Multi-zone Building," Sep. 2020, IEEE Transactions on Control Systems Technology, 28(5):2061-2068. Doi: 10.1109/TCST.2019.2949546.

* cited by examiner

METHOD AND SYSTEM FOR SCALABLE EMBEDDED MODEL PREDICTIVE CONTROL OF HVAC SYSTEMS

SUMMARY

The present disclosure is directed to identifying suitable models for model predictive control of building heating, ventilation, and air conditioning, e.g., scalable models that can be solved in real-time. In one embodiment, a physics model of a building is determined. The physics model is linearized around an operating point. The linearized physics model defines thermodynamic relationships between zones of the building and a heating, ventilation, and air-conditioning (HVAC) system. Measurements received from sensors define a system state of the HVAC system. The linearized physics model is used as an equality constraint for a model predictive controller that determines a next control input to the HVAC system based on the system state by solving an optimization problem for a time horizon of size N. A constraint matrix H of the equality constraint into factors of a first matrix U and a second matrix V such that $UU^T$ and $V^T V$ are both diagonal matrices. An objective function of the model predictive controller is optimized by iteratively solving a linear system of equations that includes inverses of $UU^T$ and $V^T V$ to determining a sequence of inputs for a horizon of the model predictive controller. A first input of the sequence of inputs to is input to control the HVAC system.

These and other features and aspects of various embodiments may be understood in view of the following detailed discussion and accompanying drawings.

BRIEF DESCRIPTION OF THE DRAWINGS

The discussion below makes reference to the following figures, wherein the same reference number may be used to identify the similar/same component in multiple figures. The figures are not necessarily to scale.

DETAILED DESCRIPTION

Figure 1:
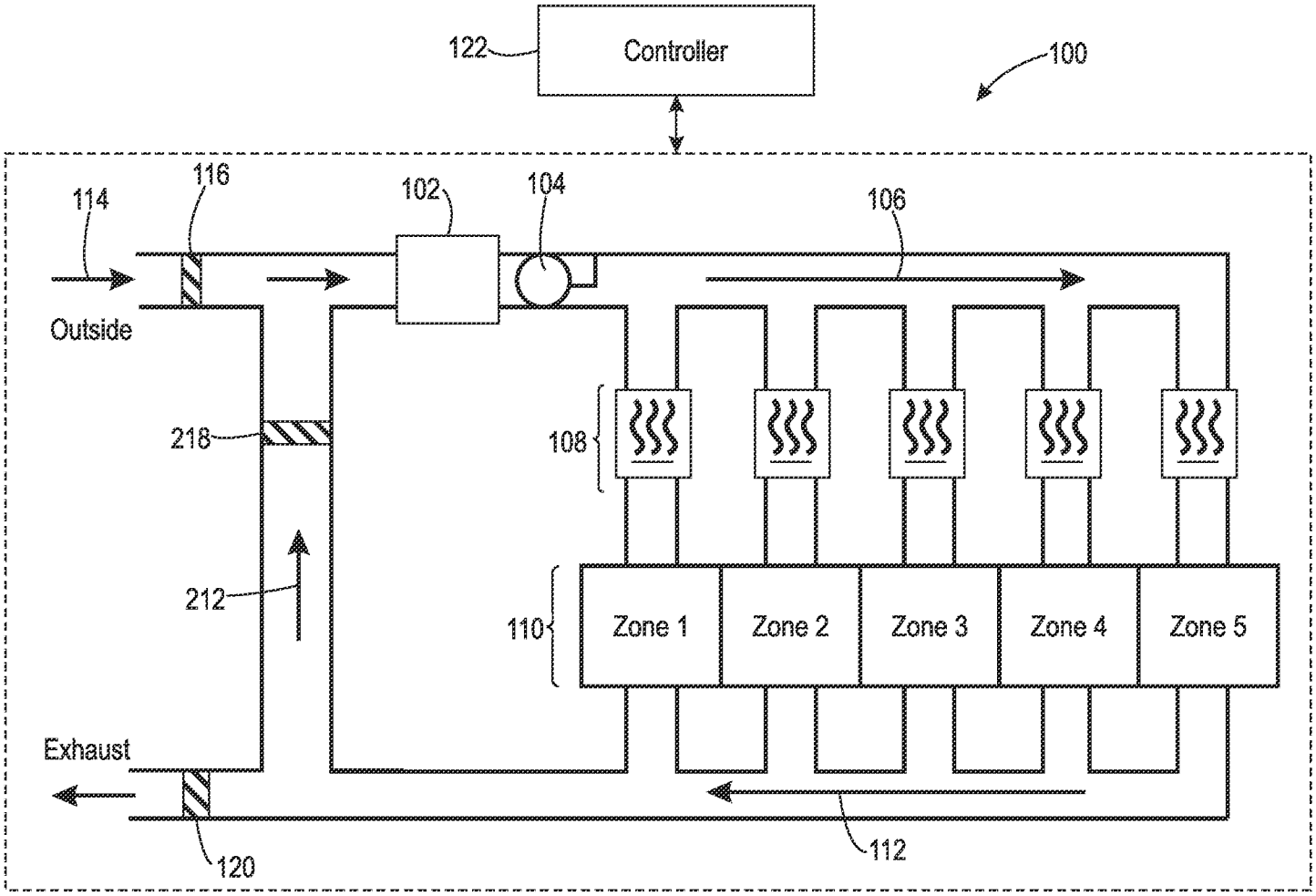
FIG. 1 is a block diagram depicting a model used to demonstrate configuration of a controller according to example embodiments.

The present disclosure is generally related to heating, ventilation, and air-conditioning (HVAC) systems. Embodiments include a method and system that use an efficient optimization framework based on first order method with a novel factorization. This framework increases the computational efficiency and the scalability for solving large-scale model predictive building control problems with computationally expensive models.

1. Introduction

According to recent estimates, residential and commercial buildings account for nearly 40% of energy usage in the United States. Most of this energy provides services to occupants, the greatest chunk of which can be associated with cooling and heating of spaces for occupant comfort and satisfaction. Better management of HVAC control systems can improve indoor thermal conditions and lead to more pleasant living spaces, better working conditions, and safer environments. Specific examples include better productivity in offices, better learning performance and pupil attendance in classrooms, and more recently, mitigation of transmission of COVID-19 in office buildings and hospitals. These can be achieved through a combination of heating and cooling for the indoor environment, more outdoor air circulation, and stricter standards for space pressure control, but may come at the cost of increasing the energy consumption for buildings and contributing to more carbon emission and less energy efficiency.

The problem quickly scales up for a large number of buildings where the HVAC control system can play the part of a variable load in a coordinated and integrated grid. To mitigate and manage, advanced controls, implemented as a supervisory control system, can be used to serve multiple end-use cases such as load shifting, demand response, and islanding. Model predictive control (MPC) is a particularly powerful approach for handling hard constraints for state and control inputs in nonlinear multivariable control systems. Generally, MPC is implemented as a controller that uses a current system state to determine a sequence of inputs for a horizon, generally a time horizon of size N. A first input of the sequence of inputs is applied to the control the HVAC system, after which the MPC controller uses the next system state at the next time to predict the inputs and resulting states over the next time horizon.

In simulation studies as well as field studies without time or budget constraints on the modeling process, MPC is the standard for comfort-oriented and energy-efficient building control, as long as a model of the plant exists or can be formulated and identified. MPC can reduce the cost by predicting the dynamically evolving temperature and humidity profile of the building based on the inside/outside influence and by optimal changing the temperature/humidity profile based on price structures to shift the energy load from peak hours to off-peak hours. This is considerably more efficient than heuristics based control approaches which do not predict the future model, varying model parameters or time-varying cost functions.

In practice, MPC has not found much use in consumer products due to implementability and dependability, where factors to consider include implementation of advanced numerical optimization algorithms on resource-limited embedded computing platforms and the associated complexity of verification. This challenge comes from a requirement of the use of ultra-reliable hardware and software architectures and low-cost hardware in consumer products. Solving a single optimization problem for a large building on low cost embedded controllers is infeasible using state of the art optimization methods. Common methods such as interior point and active set methods and more recently first order all have limitations when deployed in low computing devices. Interior point methods have scalability issue and require solvers that are not compatible with edge implementation. In first order methods, solving the linear system of equations or KKT matrix requires performing a large matrix inversion in a loop which creates the bottleneck for low computing implementation.

To deal with this problem regarding matrix inversion, direct and indirect approaches have been adopted. A direct approach computes the factors in a first iteration and then reuses them in subsequent iterations. An LDL decomposition is a method of choice in such applications. For large scale problems, the direct methods become prohibitive and indirect methods such as Preconditioned Conjugate Gradient (PCG) are iterative methods and provide an approximate solution and hence compromise on the quality of solution.

In this disclosure, we show a computationally efficient and scalable solution for solving large-scale model predictive building control problem. For purposes of this disclosure, large-scale models include those with four or more zones that are independently controllable and include a combination of central HVAC components, e.g., chillers, and zone-specific components, e.g., dampers, heaters, etc.

2. System Model

In FIG. 1, a block diagram depicts a model 100 of a building and HVAC system used to demonstrate development of an MPC controller according to example embodiments. The illustrated model 100 is provided for purposes of illustration and not limitation. The proposed methodology described further below can be adapted to a variety of different systems and architectures with minimal effort. For example, while the illustrated example shows five independently controlled zones 110, this can be extended to more or fewer zones. Further, this can be extended to multiple buildings that share HVAC services. While there may be no direct thermal interaction between zones of physically separate buildings, there can be thermal considerations worth considering when modeling the commonly shared HVAC services and components, e.g., heat loss or gain between buildings in thermal fluid pipes.

In the example model 100, a central cooling system 102 regulates the supply air temperature. A supply fan 104 controls the total airflow rate. The supply air 106 (central chilled) is divided equally between five separate zones 110 and is fed to each individual zone 110 via a variable air volume (VAV) reheat box 108. Each VAV reheat box 108 includes a heating unit (e.g., heating coil) and dampers. The reheat boxes 108 control zone-specific supply temperatures and flow rates to comply with the thermostat set points of each individual zone 110. The return air 112 from the zones is mixed with a fraction of outside air to achieve ventilation requirements. We use a thermal resistance-capacitance (RC) model to track average zone-level temperatures and neglect humidity.

2.1 Dynamics for Zone Temperatures

Figure 2A:
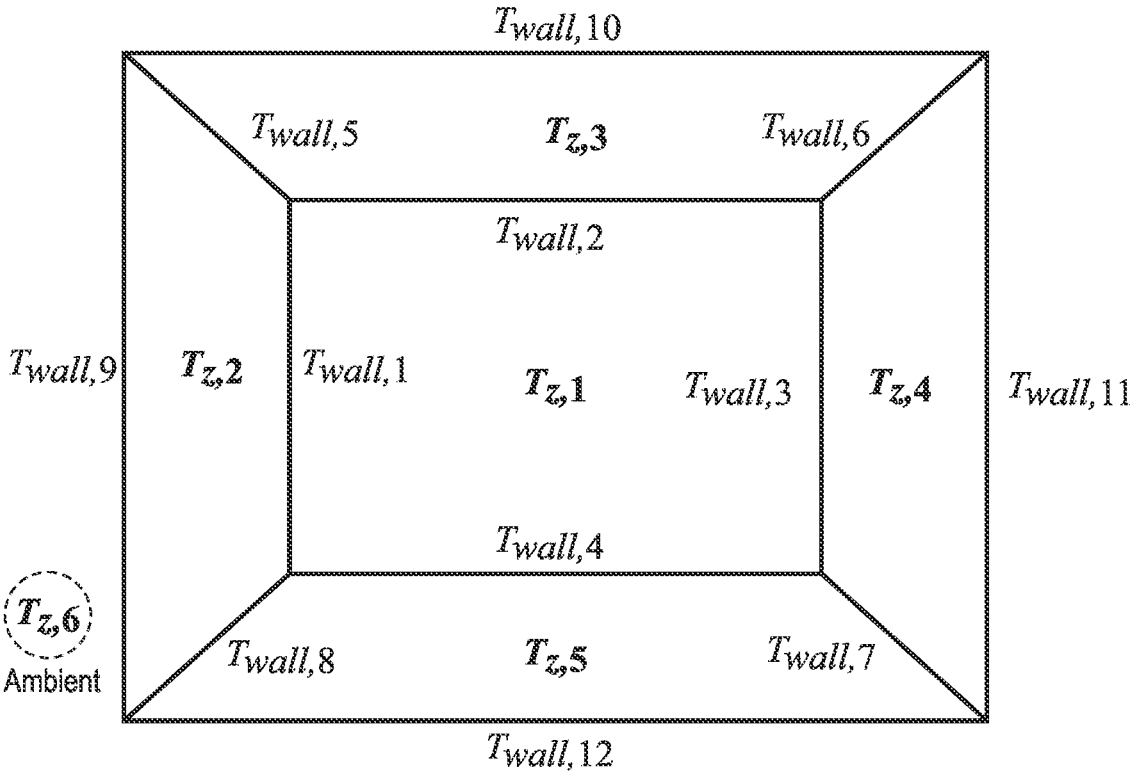
FIGS. 2A and 2B are a block diagrams showing the physics relationships used in modeling a building according to an example embodiment.
Figure 2B:
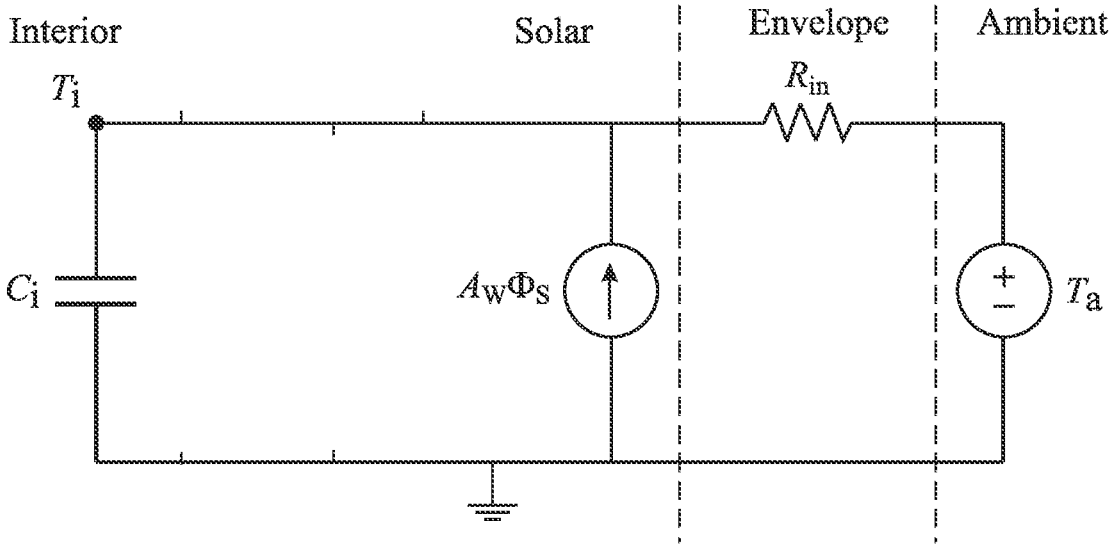

In FIG. 2A, a diagram shows part of a building layout used to demonstrate the physics equations used in modeling the building. In FIG. 2B, a diagram shows an RC-network model representation for a zone (excluding the heater). We consider a thermal zone i with temperature $T_{z,i}$ and thermal capacitance $C_i$. Suppose there is a neighboring wall with temperature $T_{wall,j}$ and thermal capacitance $C_{wall,j}$, has thermal interactions with the zone i represented by a thermal resistance $R_{ij}$.

Applying Kirchhoff's law, in continuous time the total heat load on a thermal node i for n zone building can be expressed via the following differential equations $$C_i \frac{dT_{z,i}}{dt} = \sum_{j \in N_{wall,i}} \frac{T_{wall,j} - T_{z,i}}{R_{ij}} + \dot{Q}_{tot,i} \tag{1a}$$

$$C_{wall,j} \frac{dT_{wall,j}}{dt} = \sum_{l \in N_{z,j}} \frac{T_{z,l} - T_{wall,j}}{R_{lj}} \tag{1b}$$

-continued $$\dot{Q}_{tot,i} = \dot{Q}_{occ,i} + \dot{Q}_{sol,i} + \dot{Q}_{hvac,i} + \dot{Q}_{other,i} \tag{1c}$$

$$\dot{Q}_{hvac,i} = \dot{m}_{z,i} c_{pa} (T_{supp,h,i} - T_{zi}), \tag{1d}$$

$$\dot{Q}_{sol,i} = A_w^i \eta_{sol} \tag{1e}$$

where $\mathcal{N}_{wall,i}$ are the neighboring walls of a zone i which has thermal interactions with it. Similarly, $\mathcal{N}_{z,j}$ are the neighboring zones of a wall j. For example, $\mathcal{N}_{z,1}=\{1, 2\}$ and $\mathcal{N}_{wall,2}=\{1, 5, 8, 9\}$ in the arrangement shown in FIG. 2A. We considered the ambient temperature as $T_{z,6}$. The total thermal current on a zone i comprises of $\dot{Q}_{occ,i}$ representing, occupant thermal load, $\dot{Q}_{sol,i}$ solar irradiation, $\dot{Q}_{hvac,i}$ heat due to supply air entering the room and $\dot{Q}_{other,i}$ other stochastic disturbances (equivalent to a process noise in state space form). $T_{supp,h,i}$ represents the supply air temperature entering the zone i with specific heat capacity $C_{pa}$, and $A_w^i$, $\eta_{sol}$ are window area for zone i and measured solar irradiance respectively. The variable $\dot{m}_{z,i}$ is the supply airflow for zone i.

2.2 Dynamics of the HVAC and VAV Boxes

Typically a commercial HVAC systems have a central unit supplying air to several distributed components. Without loss of generality, we can also assume that each of these components are controlled by fine-tuned proportional-integral (PI) controllers as is common practice in commercial buildings. Looking at FIG. 1, the supply air with temperature $T_{supp,c}$ is distributed to all the zones, where it is reheated to $T_{supp,h,i}$ by a water-based heating coil associated with zone i.

We consider a PI controlled water-based cooling coil system that manipulates the water flow rate $\dot{m}_{w,c}$ in order to track a desired supply air temperature (cooling):

$$\dot{m}_{w,c}(t + \Delta t) = k_p(T_{supp,c}(t) - T_{cs}(t)) + k_i \int_0^t (T_{supp,c} - T_{cs}) dt \tag{2}$$

The dynamics of cooling supply is given by:

$$\frac{d}{dt}[\rho_a V c_{pa} T_{supp,c}] = \dot{m}_{w,c} c_{pw} [T_{w,in} - T_{w,out}] - \left(\sum_i \dot{m}_{z,i}\right) c_{pa} [T_{supp,c} - T_{mix}] \tag{3}$$

where, $\rho_a$ is the density of air at 27° C., V is the volume of the heat exchanger, $T_{w,in}$, $T_{w,out}$ are the water side temperatures and $T_{mix}$ is the inlet temperature of the cooling coil. On a side note, $C_{pa}$ may be considered to be constant and not vary with respect to air temperature. If we account for the temperature variation of $C_{pa}$ in (3), then (3) is a nonlinear differential equation. For simplicity, depending on the temperature range, we assumed that $C_{pa}$ is constant.

Further, $T_{mix}$ is the mixed air temperature at the inlet of cooling system. Assuming no heat loss or gain in the ducts, the mixed air temperature is calculated as:

$$T_{mix} = r_{mix} T_{amb} + (1 - r_{mix}) T_{z,avg} \tag{4a}$$

$$T_{z,avg} = \frac{1}{n} \sum_{i=1}^{n} t_{z,i} \tag{4b}$$

from all the room exhausts $T_{z,avg}$ plus outside air given some mixing ratio rmix. The supply air with temperature $T_{supp,c}$ is distributed to all five zones, in each of which it is reheated to $T_{supp,h.i}$ by a water-based heating coil associated with zone i and controlled by a PI controller:

$$\dot{m}_{w,h,i}(t+\Delta t) = k_{p.i}(-T_{supp,h,i}(t) + T_{zs,i}(t)) + k_{int,i}\int_0^t (-T_{supp,h,i} - T_{zs,i})dt \quad (5)$$

where $k_p$, $k_{p,i}$ and $k_i$, $k_{int,i}$ are PI controller gains for central cooling and reheat boxes, respectively.

$$\frac{d}{dt}[\rho_a V c_{pa} T_{supp,h,i}] = \dot{m}_{w,h,i} c_{pw}[T_{w,in,i} - T_{w,out,i}] - \dot{m}_{z,i} c_{pa}[T_{supp,h,i} - T_{supp,c}] \quad (6)$$

3. Technical Approach

3.1 Identifying a Suitable Model for Model Predictive Control

For each iteration of the control problem, we identify a locally linear model (e.g., linearized around a current operating point) using the states x, control inputs u, time-varying disturbances d. The output of the surrogate model is the future state prediction $x_t+1$:

$$x_{t+1} = f(x_t, u_t, d_t)$$

where f is the nonlinear dynamics for combined HVAC and zone models explained earlier. Here, f is linearized as follows:

$$x_{t+1} = \Sigma_{k=0}^{M_x} A_k x_{t-k} + \Sigma_{k=0}^{M_u} B_k u_{t-k} + \Sigma_{k=0}^{M_d} C_k d_{t-k}$$

where $A_k=\nabla_x f \in \mathbb{R}^{N_x \times N_x}$, $B_k=\nabla_{uf} \in \mathbb{R}^{N_x \times N_u}$, and $C_k=\nabla_{df} \in \mathbb{R}^{N_x \times N_d}$ are learnable parameter matrices for state, control input and disturbance, respectively and $\nabla_x f$ represents the Jacobian matrix (derivative with respect to state x) and $\nabla_u f$ represents the Jacobian matrix (derivative with respect to state u).

3.2 Problem Formulation of Model Predictive Control

Model Predictive Control (MPC) is often formulated as sparse or dense Quadratic Programming (QP) problem. We consider MPC formulation of a linear and time-invariant system $$\text{minimize } \sum_{k=0}^{N-1} x_k^T Q x_k + x_k^T Q_N x_N + u_k^T R u_k \quad (7a)$$

$$\text{subject to } x_{k+1} = Ax_k + Bu_k + Cd_k \quad (7b)$$

$$x_{min} \le x_k \le x_{max} \quad (7c)$$

$$u_{min} \le u_k \le u_{max} \quad (7d)$$

$$x_N = \chi_f \quad (7e)$$

$$x_0 = x(0) \quad (7f)$$

where $x_k \in \mathbb{R}^{n_x}$ and $u_k \in \mathbb{R}^{u_n}$ are state and control input vectors, respectively. The states and control input of system are subject to polyhedral constraints and are bounded by their respective minimum and maximum values. The matrices $Q \in S_+^{n_x}$ and $R \in S_{++}^{n_u}$ are state and control penalty costs at each stage horizon, respectively, whereas $Q_N \in S_+^{n_x}$ is the terminal stage cost.

It is a common practice to formulate MPC problem as a box constrained quadratic programming problem and then apply optimization methods to solve this problem. Alternating Direction Method of Multiplier (ADMM) is one of famous optimization method and various solvers for MPC applications are developed on the basis of this approach. In contrary to common practice, we formulate the MPC problem as a standard quadratic problem (e.g., mathematical optimization problem involving quadratic objective function) where we minimize a quadratic objective function subject to a set of linear equality and inequality constraints. Such formulation can be obtained by introducing the slack variable for corresponding lower and upper bounds constraints (7c) and (7d) of state and input of the system. equations (1)-(4):

$$\text{minimize: } \frac{1}{2} Z^T P z + q^T z \quad (8a)$$

$$\text{subject to: } Hz + s = b \quad (8b)$$

$$s \ge 0 \quad (8c)$$

where the variable $z \in \mathbb{R}^n$ is the new unknown variable, $P \in \mathbb{S}_+^n +$ and $q \in \mathbb{R}^n$ are corresponding objective function costs, $H \in \mathbb{R}^{nxm}$ is the compact constraint matrix, and $s \in \mathbb{R}^m$ the slack variable. The transformation of variables from (7) to (8) is defined as follows:

$$z = [x_0, \ldots, x_N, u_0, \ldots, u_{N-1}]^T$$

We rewrite the objective of (8) by defining P=diag $\{Q_1, Q_2, \ldots, Q_N, R_1, \ldots, R_N\}$ and $q=[Q_1 x_f Q_2 x_f \ldots Q_N x_f O^{N \times n_u}]^T$. The equality constraint associated with (7b) in MPC formulation can be casted as $$A_{eq} = \begin{bmatrix} -I & & & & & \\ A & -I & & & B & \\ & A & -I & & & B \\ & & \ddots & \ddots & & & \ddots \\ & & & A & -I & & & B \end{bmatrix}$$

whereas the inequality constraint (7*c*) and (7*d*) is $A_{ineq}=I^{(N+1)\times n_x + N \times n_u}$.

The new equality constraint of reformulated quadratic program is defined as $H=[A_{eq} - A_{ineq} A_{ineq}]^T$ and the transformed system matrix b is given as $$b = [-x(0) \;\; 0^{N \times n_x} \;\; -x_{min} \times 1^{N+1} \;\; -u_{min} \times 1^N \;\; x_{max} \times 1^{N+1} \;\; u_{max} \times 1^N]^T.$$

4. Solving the Mpc Problem

Motivated by the need of solving real-time MPC for finite horizon in large scale buildings and multi-building installations, we aim to solve this problem in a computationally efficient manner. For purposes of this disclosure, "real-time" refers to a system that can respond with control inputs sufficiently fast enough so that the system state does not change significantly (e.g., <5%) from when the measurements are made to when the inputs are applied. For example, a convergence time on the order of minutes (e.g., <5 minutes) for the control calculations can be sufficient for many HVAC applications.

Furthermore, it is desirable that a system achieve real-time performance on inexpensive and/or readily available computer equipment, such as embedded controllers, consumer grade computers, etc. In this way, and organization can maintain internal control of HVAC systems without reliance on cloud computing or other external services, which removes a possible security risk and can ensure data privacy. For example, a security policy can be implemented that prevents the controller nodes from connecting to the Internet or significantly reduces Internet access.

The ability to run advanced HVAC control on relatively lower-performance devices (e.g., single board computers) can also make parallel-computing implementations economically feasible. Generally, parallel computing or parallelism involves multiple controllers that cooperatively execute control functions, such as by providing redundancy and/or load sharing. Parallelism can provide, among other things, increase in performance by subdividing computing tasks and increase reliability by operating redundant/backup computing nodes. Parallel computing nodes can also be physically distributed around an installation (e.g., placed in multiple different buildings) which can add another layer of resilience to the control system. This can increase adoption of advanced MPC controllers which will lead to increased operational HVAC efficiencies. Scalability of the models to large installations (e.g., multiple building campuses with shared HVAC resources) can further increase the payback resulting from these efficiencies.

We disclose a first order method in conjunction with a novel UV factorization method to increase the scalability and reduce the computational complexity for solving large-scale MPC problems.

4.1 Decomposition of Constraint Matrix

As a first step in this solution, we decompose the constraint matrix H=UV $\in \mathbb{R}^{mxn}$ into two factors ($U \in \mathbb{R}^{nxo}$, $\mathbb{R}^{nxm} \in \mathbb{R}^{oxm}$) in such a way that $UU^T$ and $V^T V$ are both diagonal. Here o is the number of non-zero elements of H. The factor U contains a single non-zero element in each column, whereas V contains a single non-zero entry in each row. These factors can be computed as follows:

$$U \triangleq \sum_{k=1}^{o} H_{i_k,j_k} e_{i_k} f_k^{\top} \tag{9}$$

$$V \triangleq \sum_{k=1}^{o} f_k g_{j_k}^{\top} \tag{10}$$

where $e_{k_{k=1}}{}^{m} \in \mathbb{R}^{m}$, $f_{k_{k=1}}{}^{o} \in \mathbb{R}^{o}$ and $g_{k_{k=1}}{}^{n} \in \mathbb{R}^{n}$ are standard basis and $H_{ik,jk}$ are the non-zero elements of H. Based on this decomposition the MPC problem (8) can be reformulated as $$\text{minimize: } \frac{1}{2} z^T P z + q^T z \tag{11a}$$

$$\text{subject to: } Uy + s = b \tag{11b}$$

$$y = Vz \tag{11c}$$

$$z = w \tag{11d}$$

$$s \geq 0 \tag{11e}$$

where $y \in \mathbb{R}^{m}$ and $w \in \mathbb{R}^{n}$ are auxiliary variables in (11c) and (11d), respectively. In order to solve (11) we apply Augmented Lagrangian Method and the corresponding Lagrangian for (11) is given as:

$$\mathcal{L}(s, w, y, z) = 1/2\ z^{\top} P z + q^{\top} z + \lambda_1^{\top}(Uy + s - b) + \lambda_2^{\top}(y - Vz) + \lambda_2^{\top}(z - w) + \frac{\mu}{2}\left(\|Uy + s - b\|_2^2 + \|y - Vz\|_2^2 + \|z - w\|_2^2\right) \tag{12}$$

where $\lambda_1 \in \mathbb{R}^{m}$, $\lambda_2 \in \mathbb{R}^{n}$ and $\lambda_3 \in \mathbb{R}^{n}$ are the corresponding Lagrange multipliers associated with (11b), (11c) and (11d), respectively, and μ is a constant penalty weight. The closed form solution of iterative steps of the algorithm can be computed by minimizing the Lagrangian function with respective to the corresponding variable and freezing the other variables at their previous values.

$$z^{k+1} = \underset{z}{\operatorname{argmin}}\ \mathcal{L}(w^k, s^k, y^k, z, \lambda_1^k, \lambda_2^k, \lambda_3^k)$$

$$y^{k+1} = \underset{y}{\operatorname{argmin}}\ \mathcal{L}(w^k, s^k, y^k, z, \lambda_1^k, \lambda_2^k, \lambda_3^k)$$

$$w^{k+1} = \underset{w}{\operatorname{argmin}}\ \mathcal{L}(w, s^k, y^k, z^{k+1}, \lambda_1^k, \lambda_2^k, \lambda_3^k)$$

$$s^{k+1} = \underset{s \geq 0}{\operatorname{argmin}}\ \mathcal{L}(w^{k+1}, s, y^{k+1}, z^{k+1})$$

The update for each of the variables can be computed by finding the following closed form solution. The updates for Lagrangian multipliers are also easy to compute.

$$z^{k+1} = (P + \mu V^{\top} V + \mu I)^{-1}[-q + V(\lambda_2 + \mu y) - \lambda_2 + \mu w] \tag{13}$$

$$y^{k+1} = (I + U^{\top} U)^{-1}\left[U^{\top}\left(-\mu^{-1}\lambda_1 - s + b\right) - \mu^{-1}\lambda_2 + Vz\right] \tag{14}$$

$$w^{k+1} = z - \mu^{-1}\lambda_3 \tag{15}$$

$$s^{k+1} = \max\left(0, -\mu^{-1}\lambda_1 + b - Uy\right] \tag{16}$$

4.2 Solving the Linear System

The variable updates in (13) and (14) involves solving the linear system of equations in each iteration. This system remains constant throughout the iterative steps, hence it is computationally beneficial to find the factors in first iteration and then reuse them in subsequent iterative steps. Since, we are dealing with large-scale and highly sparse system, the traditional factorization techniques becomes computationally prohibitive. The inherent structure of MPC problem and reformulation introduced in (11) provides a computationally efficient approach to deal with this problem. Based on this decomposition, the $(P+\mu V^T V+\mu I)$ term in in equation (13) is diagonal and it easy to compute the inverse of this term. Additionally, the term $U^T U$ in (14) is apparently not diagonal, but we will apply matrix inversion lemma to make this term diagonal. According to matrix inversion lemma $$(I + UV)^{-1} = I - U(I + VU)^{-1} V$$

we can write $(I+U^T U)^{-1}$ as follows:

$$(I+U^\top U)^{-1} = I - U^\top (I+UU^\top)^{-1} U \tag{17}$$

In equation (17), the term $(I+UU^T)$ becomes diagonal which is easy to compute.

Algorithm IFMPC Inverse free algorithm for solving large-scale MPC problems

Input: (P, q, H, b), fixed $\mu > 0$, and initial points $w \in \mathbb{R}^n$, $z \in \mathbb{R}^n$, $y \in \mathbb{R}^m$, $s \in \mathbb{R}^m$ 1: Construct a UV decomposition based on non-zero elements of H
2: $U_i := I - U^T(I + UU^T)^{-1}U$
3: $V_i := (P + \mu V^T V + \mu I)^{-1}$
4: repeat
5: $z \leftarrow V_i\,[(-q + V^T(\lambda_2 + \mu y) - \lambda_3 + \mu w]$
6: $y \leftarrow U_i\,[U^T(-\mu^{-1}\lambda_1 - s + b) - \mu^{-1}\lambda_2 + Vz]$
7: $w \leftarrow z - \mu^{-1}\lambda_3$
8: $s \leftarrow \max(0, -\mu^{-1}\lambda_1 + b - Uy)$
9: $\lambda_1 \leftarrow \lambda_1 + \mu(Uy + s - b)$
10: $\lambda_2 \leftarrow \lambda_2 + \mu(y - Vz)$
11: $\lambda_3 \leftarrow \lambda_3 + \mu(z - x)$
12: until stopping criterion is met Output: $z^* \leftarrow z$, $s^* \leftarrow s$, $y^* \leftarrow y$ 4.3 Inverse-Free Algorithm for MPC By finding the closed form solution of primal variables and Lagrange multipliers updates in previous discussion, we converge to Algorithm 1 for dealing with large-scale real-time MPC problem. A brief description of each step of the algorithm is provided in this section. The algorithm takes P, q, H, and b as input.

Step 1: A UV decomposition of constraint matrix H is computed.

Steps 2 and 3: We compute the multiplication factors in these steps. These steps are easy to compute as it involves inverse of diagonal matrix.

Steps 5 and 8: The steps update the primal variables of (11) by using the closed form solution given in (13), (14)(15)(16)

Steps 9 and 11: Updates for Lagrange multipliers is provided.

The algorithm returns the optimal values of variables as output when a satisfactory termination criterion is met. In this algorithm we use the following stopping criteria.

$$\|Hx + s - b\|_\infty < \varepsilon_{abs} + \varepsilon_{rel}\max\{\|Hx\|_\infty, \|b\|_\infty\} \tag{18a}$$

$$\|Px + H^\top\lambda + q\|_\infty < \varepsilon_{abs} + \varepsilon_{rel}\max\{\|Px\|_\infty, \|H^\top\lambda\|_\infty, \|q\|_\infty\} \tag{18b}$$

where $\varepsilon_{abs}=10^{-4}$ and $\varepsilon_{rel}=10^{-3}$ are default absolute and relative tolerance values, respectively.

The proposed algorithm is computationally efficient, requires less memory and amenable for warm-start. The algorithm is well suited for model predictive control applications as it exploits the sparsity structure of this problem and uses only the non-zero elements for operations. Moreover, the warm-start feature of this algorithm is very important in MPC problem as it requires to compute the factors only in first horizon of time and then it can be reused for the whole horizon.

Figure 3:
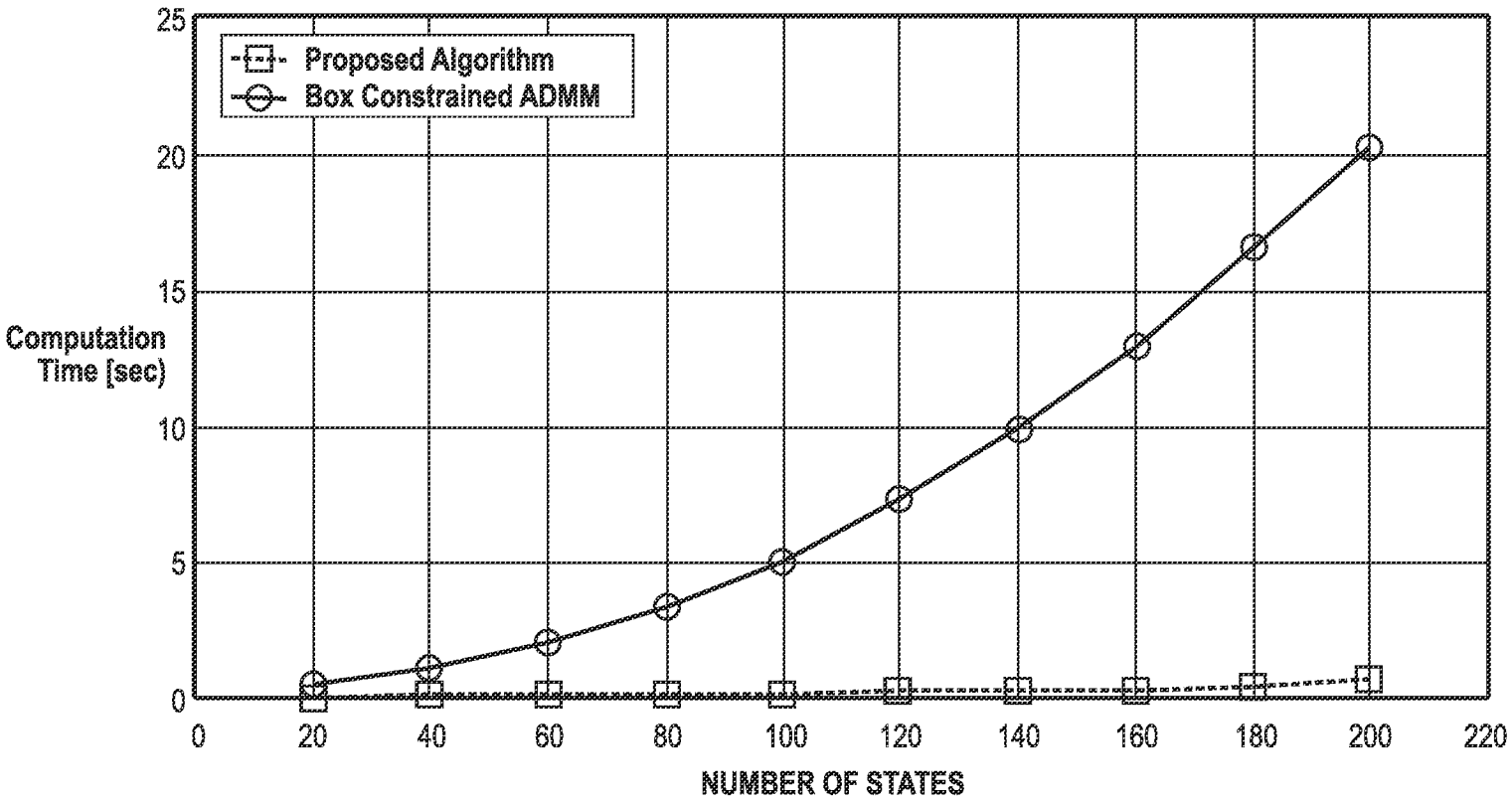
FIGS. 3 and 4 are graphs comparing computational time of an algorithm according to an example embodiment with existing algorithms.

5. Simulation Studies to Validate the Approach 5.1 Comparison with ADMM algorithm of box-constrained QP In order to evaluate the performance of proposed formulation and algorithm, we generate random MPC problem instances and vary the size of problem (by increasing the number of states) and compare the computational performance of proposed algorithm with a commonly used Alternating Direction Method of Multipliers (ADMM) method on a box-constrained formulation of MPC. In these instances, we use 10 control inputs and solve the problem for 50 horizons. As illustrated in FIG. 3, the proposed method outperforms the state-of-art approach and performance gain increases exponentially as the problem size increases.

Figure 4:
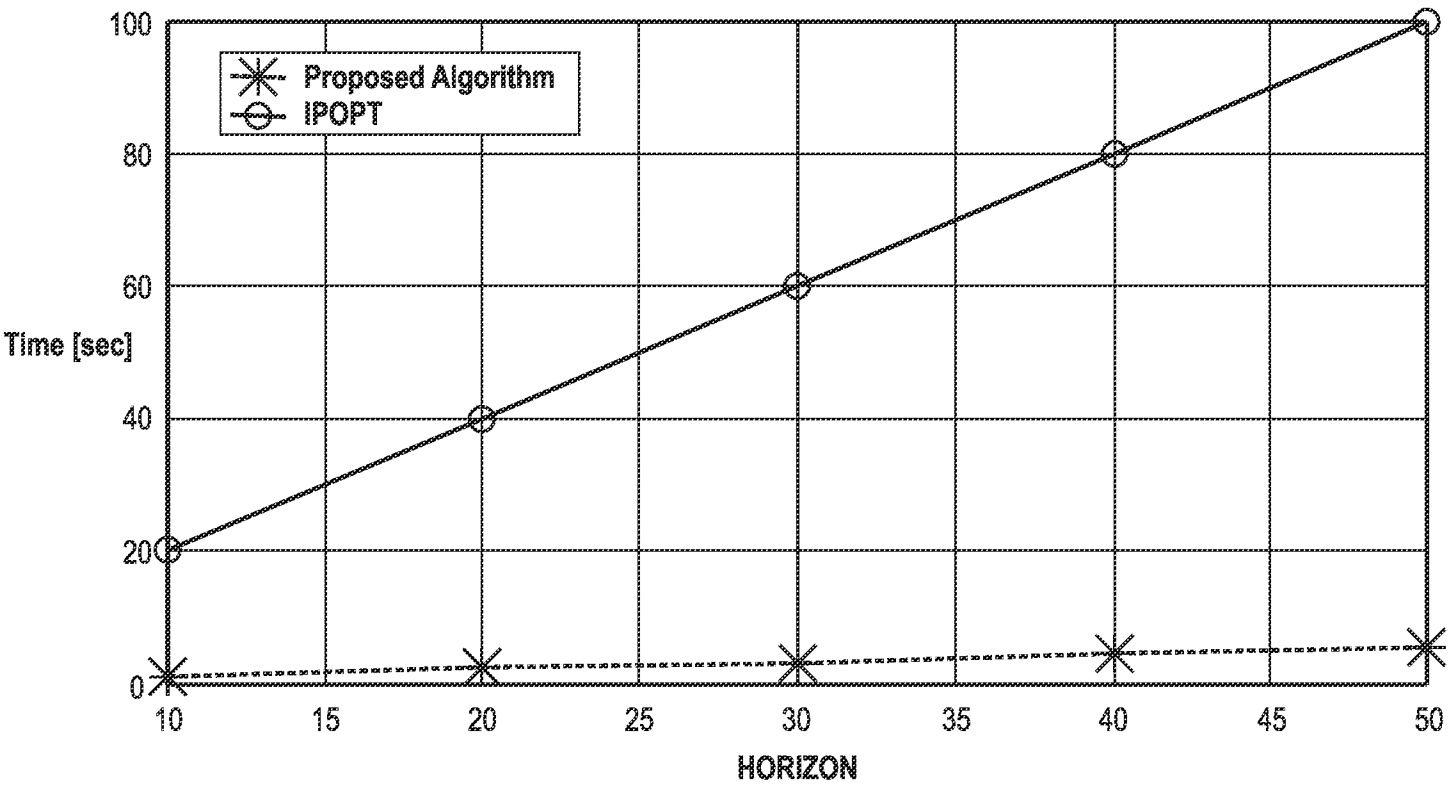

The performance of proposed algorithm to be at least 20x times faster than IPOPT, as seen in the graph of FIG. 4. A Van der Pole oscillator is an example of a non-linear self-oscillatory system and can be used as a test case system for evaluating a controller. The system of equations for Van der Pole Oscillator is given as follows:

$$\dot{x}_1 = x_1(1-x_2)^2 - x_2 + u$$

$$\dot{x}_2 = x_1$$

Figure 5:
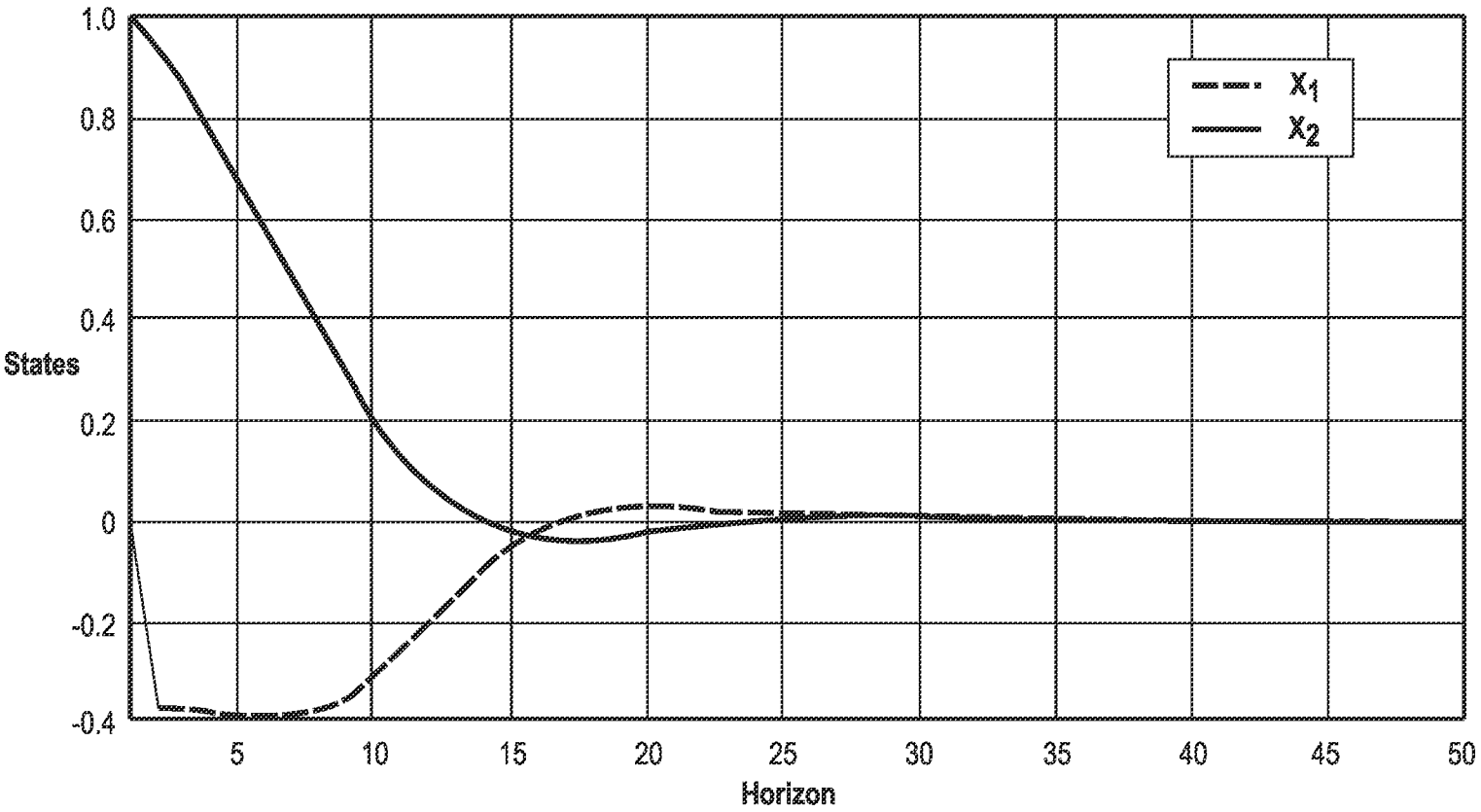
FIGS. 5 and 6 are graphs showing Model Predictive Control of Van der Pole Oscillator by an algorithm according to an example embodiment.
Figure 6:
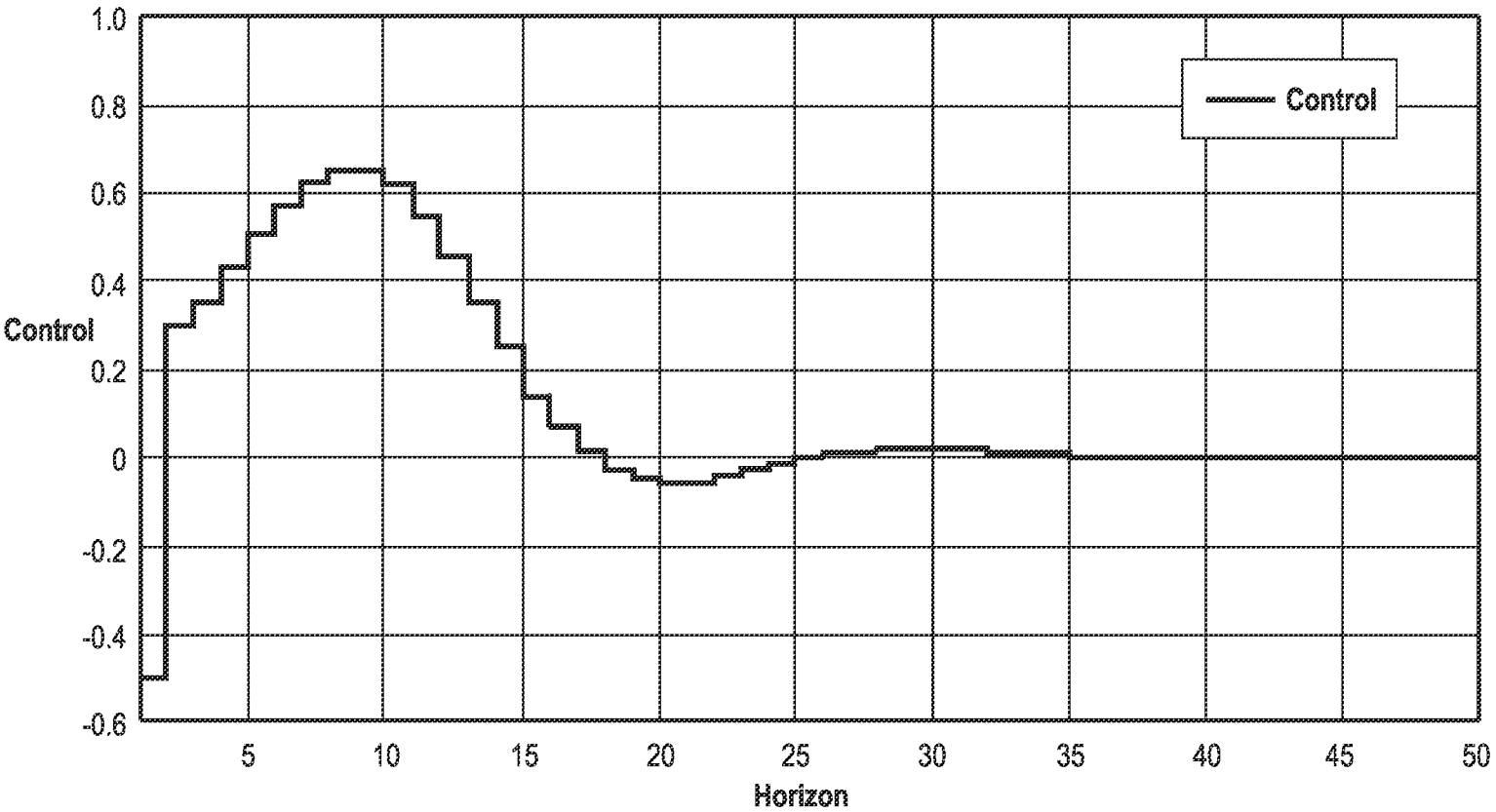

The initial states are $$\begin{bmatrix} x_1 \\ x_2 \end{bmatrix} = \begin{bmatrix} 0 \\ 1 \end{bmatrix}$$

and control input is $-0.75 \le u \le 1$. In FIGS. 5 and 6, graphs show states and control inputs for Model Predictive Control of Van der Pole Oscillator using the proposed algorithm.

Figure 7:
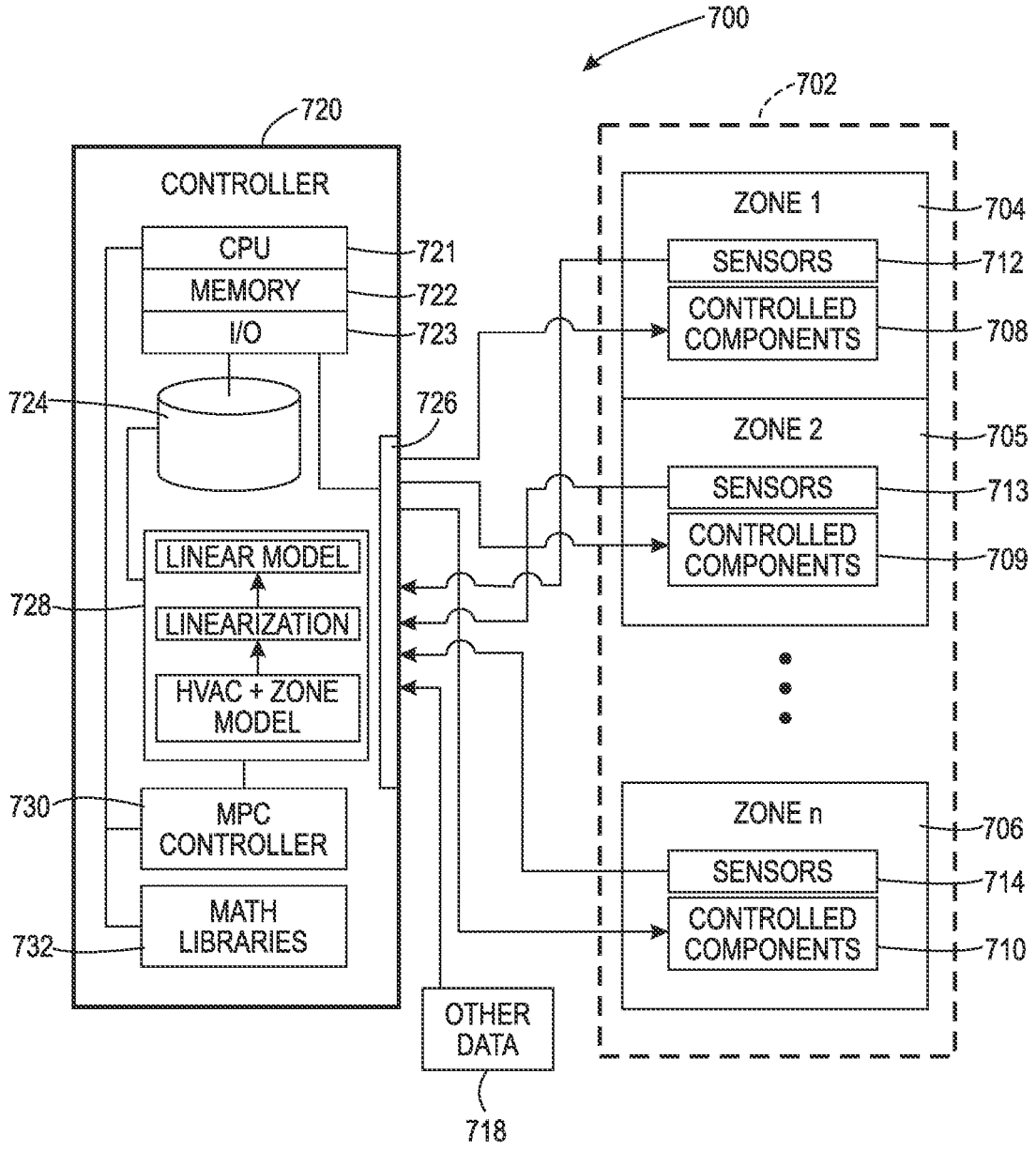
FIG. 7 is a block diagram of an apparatus and system according to an example embodiment.

Note that the embodiments above can be implemented in multi-zone HVAC systems that are centrally controlled. In FIG. 7, a block diagram illustrates a system 700 according to an example embodiment. The system pertains to one or more buildings 702 that are divided into a number of zones 704-706 that correspond to physical partitions of the buildings 702 whose states (e.g., temperature, humidity) are governed by thermodynamic relations between the zones 704-706 and throughout the buildings 702 as a whole (e.g., solar irradiance on the buildings 702). Note that, for purposes of the description of this system 700, the zones 704-706 may include both separate partitions with individual controlled components/sensors and centralized controlled components/sensors that directly affect multiple zones. For example, the central cooler 102 and supply fan 104 shown in FIG. 1 may be considered part of Zone 0, the control of which affects all of Zones 1-5. Also note that the buildings 702 may encompass multiple structures that use a common HVAC system.

The system 700 uses conventional HVAC components (e.g., compressors, evaporators, chillers, heaters, VAV boxes, solar-thermal collectors, underground or underwater heat exchangers, fans, dehumidifiers, humidifiers, etc.) to affect the movement of heat through the buildings 702, and any of those HVAC components that can be affected by an input signal are indicated as controlled components 708-710 which are each associated with one of the zones 704-706. Each of the zones 704-706 includes sensors 712-714 (e.g., temperature sensors, flow sensors, humidity sensors, solar radiation sensors, etc.) that gather state data that can be fed into a centralized controller 720. Other sources of data 718 may also be used as state inputs to the controller 720, such as occupancy sensors, Internet-accessible weather data, etc. Generally, the inputs to the controlled components 708-710 affect the state variables measured by the sensors 712-714, and each controlled component 708-710 may primarily affect the zone in which the component is located, and secondarily affect other zones, e.g., via heat transfer through inter-zone boundaries.

The controller 720 may include conventional computing hardware such as a central processing unit (CPU) 721, memory 722, input/output (I/O) interfaces 723, and a non-volatile data storage unit 724 (e.g., hard disk drives, solid state drives). The controller 720 includes an external data interface 726 that receives state information from the sensors 712-714 and sends inputs to controlled components 708-710. The data storage unit 724 stores a linear physics model 728 of the building that defines thermodynamic relationships between the zones of the building and the HVAC system. The linear physics model 728 may be stored, for example, as a data file that is loaded into memory by a program and contains parameters that can be used to update the model 728 as described herein.

During operation of the system 700, e.g., when the system 700 is actively controlling the building HVAC, physics-based model 728 is used to determine control inputs to the controlled components 708-710, as well as having their parameters jointly updated at the same time based on a series of previous states and inputs. These control inputs and parameter updates may be calculated using an optimized MPC controller 730 that utilizes algorithms described above. For example, the processor 721 uses the linear physics model as an equality constraint for MPC computation by the MPC controller 730 that determines a next control input to the HVAC system based on a system state. The MPC controller 730 decomposes a constraint matrix H of the equality constraint into a factor of a first matrix U and a second matrix V such that $UU^T$ and $V^TV$ are both diagonal matrices.

The MPC controller 730 minimizes an objective function of the MPC computation by iteratively solving a linear system of equations that includes inverses of $UU^T$ and $V^T V$ to update state and control variables of the MPC computation. The MPC controller 730 determines a current input based on the minimization of the objective function and applying the current input to control the HVAC system. Note that various optimized math libraries 732 such as matrix libraries can be used to efficiently solve the above noted matrix operations such as inverses. Generally, even a relatively large system can be controlled by this type of MPC controller 730 using low-powered computing hardware, e.g., a single board computer such as a Raspberry Pi™.

The various embodiments described above may be implemented using circuitry, firmware, and/or software modules that interact to provide particular results. One of skill in the arts can readily implement such described functionality, either at a modular level or as a whole, using knowledge generally known in the art. For example, the flowcharts and control diagrams illustrated herein may be used to create computer-readable instructions/code for execution by a hardware processor. Such instructions may be stored on a non-transitory computer-readable medium and transferred to the processor for execution as is known in the art. The structures and procedures shown above are only a representative example of embodiments that can be used to provide the functions described hereinabove.

The various embodiments described above may be implemented using circuitry, firmware, and/or software modules that interact to provide particular results. One of skill in the arts can readily implement such described functionality, either at a modular level or as a whole, using knowledge generally known in the art. For example, the diagrams and algorithms illustrated herein may be used to create computer-readable instructions/code for execution by a processor. Such instructions may be stored on a non-transitory computer-readable medium and transferred to the processor for execution as is known in the art. The structures and procedures shown above are only a representative example of embodiments that can be used to provide the functions described hereinabove.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g., 1 to 5 includes 1, 1.5, 2, 2.75, 3, 3.80, 4, and 5) and any range within that range.

The foregoing description has been presented for the purposes of illustration and description. It is not intended to be exhaustive or to limit the embodiments to the precise form disclosed. Many modifications and variations are possible in light of the above teachings. Any or all features of the disclosed embodiments can be applied individually or in any combination and are not meant to be limiting, but purely illustrative. It is intended that the scope of the invention be limited not with this detailed description, but rather, determined by the claims appended hereto.

The invention claimed is:

1. A method comprising:

determining a physics model of a building and linearizing the physics model around an operating point, the linearized physics model defining thermodynamic relationships between zones of the building and a heating, ventilation, and air-conditioning (HVAC) system;

receiving measurements from sensors, the measurements defining a system state of the HVAC system;

using the linearized physics model as an equality constraint for a model predictive controller that determines a next control input to the HVAC system based on the system state by solving an optimization problem for a time horizon of size N;

decomposing a constraint matrix H of the equality constraint into factors of a first matrix U and a second matrix V such that $UU^T$ and $V^T V$ are both diagonal matrices;

optimizing an objective function of the model predictive controller by iteratively solving a linear system of equations that includes inverses of $UU^T$ and $V^T V$ to determining a sequence of inputs for a horizon of the model predictive controller; and applying a first input of the sequence of inputs to control the HVAC system.

2. The method of claim 1, wherein an augmented Lagrangian method is used to optimize the objective function in view of the equality constraint and other equality and inequality constraint.

3. The method of claim 1, wherein optimizing the objective function of the model predictive controller comprises finding, in a first iteration a first factor comprising the inverse of the diagonal matrix $UU^T$ and a second factor comprising the inverse of the diagonal matrix $V^T V$ and reusing the first and second factors in subsequent iterative steps.

4. The method of claim 3, wherein the iterations involve using the first and second factor to update primal variables of the model predictive controller and Langrangian multipliers.

5. The method of claim 1, wherein the model predictive controller is formatted as a quadratic problem that involves optimizing a quadratic objective function subject to a set of linear equality and linear inequality constraints.

6. The method of claim 5, wherein the set of linear inequality constraints comprise upper and lower bound constraints on states and control inputs.

7. The method of claim 6, wherein the upper and lower bound constraints on states comprise zone temperature bounds and the upper and lower bound constraints on control inputs comprise control input bounds.

8. The method of claim 1, wherein the receiving of the measurements, the determination of the sequence of inputs, and the applying of the first input to control the HVAC system occurs in real-time on one or more local computing devices.

9. The method of claim 8, further comprising implementing a security policy wherein the one or more local computing devices determine the sequence of inputs independently of a cloud computing service.

10. The method of claim 8, wherein the one or more local computing devices comprises two or more local computing devices that cooperatively execute the model predictive controller.

11. A system comprising:

a heating, ventilation, and air-conditioning (HVAC) system of a building comprising two or more zones;

sensors that measure a system state of the HVAC system; and a hardware controller configured via instructions to:

determine a physics model that is linearized around an operating point, the linearized physics model defining thermodynamic relationships between the two or more zones of the building;

use the linearized physics model as an equality constraint for a model predictive controller that determines a next control input to the HVAC system based on the system state;

decompose a constraint matrix H of the equality constraint into factors of a first matrix U and a second matrix V such that $UU^T$ and $V^T V$ are both diagonal matrices;

optimize an objective function of the model predictive controller by iteratively solving a linear system of equations that includes inverses of $UU^T$ and $V^T V$ to determining a sequence of inputs for a horizon of the model predictive controller; and apply a first input of the sequence of inputs to control the HVAC system.

12. The system of claim 11, wherein an augmented Lagrangian method is used to optimize the objective function in view of the equality constraint and other equality and inequality constraint.

13. The system of claim 11, wherein optimizing the objective function of the model predictive controller comprises finding, in a first iteration a first factor comprising the inverse of the diagonal matrix $UU^T$ and a second factor comprising the inverse of the diagonal matrix $V^T V$ and reusing the first and second factors in subsequent iterative steps.

14. The system of claim 13, wherein the iterations involve using the first and second factor to update primal variables of the model predictive controller and Langrangian multipliers.

15. The system of claim 11, wherein the model predictive controller is formatted as a quadratic problem that involves optimizing a quadratic objective function subject to a set of linear equality and linear inequality constraints.

16. The system of claim 15, wherein the set of linearity inequality constraints comprise upper and lower bound constraints on states and control inputs.

17. The system of claim 11, the measuring of the system state, the determination of the sequence of inputs, and the applying of the first input to control the HVAC system occurs in real-time occurs in real-time.

18. The system of claim 11, wherein the HVAC system services two or more buildings, and wherein the linear physics model defines the thermodynamic relationships between zones of the two or more buildings.

19. The system of claim 11, wherein the hardware controller comprises two or more controllers that cooperatively execute the instructions.

20. The system of claim 11, wherein the instructions further cause the hardware controller to determine the sequence of inputs independently of a cloud computing service.

* * * * *